US011299964B2

(12) United States Patent
Hoeink et al.

(10) Patent No.: US 11,299,964 B2
(45) Date of Patent: Apr. 12, 2022

(54) DRILLING PRODUCTIVE WELLS

(71) Applicant: Baker Hughes, a GE Company, LLC, Houston, TX (US)

(72) Inventors: Tobias Hoeink, Houston, TX (US); David L. Cotrell, Houston, TX (US); Sachin Ghorpade, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 205 days.

(21) Appl. No.: 16/460,835

(22) Filed: Jul. 2, 2019

(65) Prior Publication Data

US 2020/0011157 A1 Jan. 9, 2020

Related U.S. Application Data

(60) Provisional application No. 62/693,569, filed on Jul. 3, 2018.

(51) Int. Cl.

| | |
|---|---|
| ***E21B 7/04*** | (2006.01) |
| ***E21B 44/00*** | (2006.01) |
| ***E21B 47/022*** | (2012.01) |
| ***E21B 41/00*** | (2006.01) |
| ***E21B 49/00*** | (2006.01) |

(52) U.S. Cl.

CPC ..... *E21B 41/0092* (2013.01); *E21B 7/04* (2013.01); *E21B 44/00* (2013.01); *E21B 47/022* (2013.01); *E21B 49/00* (2013.01)

(58) Field of Classification Search

None

See application file for complete search history.

(56) References Cited

U.S. PATENT DOCUMENTS

| | | | | |
|---|---|---|---|---|
| 6,549,879 | B1 * | 4/2003 | Cullick | E21B 49/00 703/10 |
| 8,849,640 | B2 * | 9/2014 | Holl | E21B 44/00 703/10 |
| 2007/0199721 | A1 * | 8/2007 | Givens | G06Q 10/06312 166/382 |
| 2010/0243328 | A1 * | 9/2010 | Rodriguez Herrera | E21B 7/04 175/61 |
| 2011/0153300 | A1 * | 6/2011 | Holl | E21B 47/022 703/10 |
| 2011/0264429 | A1 * | 10/2011 | Lee | E21B 47/022 703/10 |
| 2014/0209300 | A1 * | 7/2014 | Tilke | E21B 43/017 166/250.01 |
| 2018/0334896 | A1 * | 11/2018 | Samuel | E21B 7/04 |
| 2018/0340408 | A1 * | 11/2018 | Samuel | E21B 44/02 |

* cited by examiner

*Primary Examiner* — Lina M Cordero

(74) *Attorney, Agent, or Firm* — Mintz Levin Cohn Ferris Glovsky and Popeo, PC; Lisa Adams

(57) ABSTRACT

Reservoir properties can be received. A plurality of potential well trajectories can be determined. Each trajectory can characterize an extension of the well from a well origin position. Each trajectory can include a plurality of well segments. Production contribution of each potential well trajectory can be evaluated using the reservoir properties. A final well trajectory can be provided based on the evaluated production contribution of the potential well trajectories. Related apparatus, systems, techniques and articles are also described.

18 Claims, 8 Drawing Sheets

700

DRILLING PRODUCTIVE WELLS

CROSS-REFERENCE TO RELATED APPLICATIONS

This application claims the benefit of U.S. Provisional Application No. 62/693,569, filed on Jul. 3, 2018 and entitled "Drilling Productive Wells," the entirety of which is hereby incorporated by reference.

BACKGROUND

Well drilling can include drilling a hole in the ground, for example, for extraction of a natural resource such as ground water, natural gas, oil, petroleum, and/or hydrocarbons, for the injection of a fluid from the surface to a subsurface reservoir, or for subsurface formations evaluation or monitoring.

In some instances, before a well is drilled, a geologic target can be identified to meet the objectives of the well. For instance, for a production well, the target can be selected based on estimated production from the well and/or to manage reservoir drainage. For an exploration or appraisal well, the target can be chosen to confirm the existence of a viable hydrocarbon reservoir or to ascertain its extent. For an injection well, the target can be selected to locate the point of injection in a permeable zone, which may support disposing of water or gas and/or pushing hydrocarbons into nearby production wells.

The target (e.g., the end point of the well) can be matched with a surface location (e.g., the starting point of the well), and a trajectory between the two can be designed.

When the well path is identified, a team of geoscientists or engineers, for example, can develop a set of presumed properties of the subsurface that will be drilled through to reach the target. These properties can include, for example, pore pressure, fracture gradient, stresses, Young's modulus, Poisson's ratio, porosity, permeability, lithology, faults, and clay content. In an example, the subsurface data can be used by a well engineering team to perform the casing design and completion design for the well. Thereafter, detailed planning for executing the well in a safe and cost-efficient manner can occur, where, for example, the drill bits are selected, a bottom hole assembly (BHA) is designed, drilling fluid are selected, and step-by-step procedures are written to provide instruction for executing the well.

SUMMARY

In an aspect, reservoir properties can be received. A plurality of potential well trajectories can be determined. Each trajectory can characterize an extension of the well from a well origin position. Each trajectory can include a plurality of well segments. Production contribution of each potential well trajectory can be evaluated using the reservoir properties. A final well trajectory can be provided based on the evaluated production contribution of the potential well trajectories.

One or more of the following features can be included in any feasible combination. For example, the well can be drilled using well drilling machinery and according to the final well trajectory. The reservoir properties can include density, pore pressure, fracture gradient, stresses, saturations, Youngs modulus, Poisson's ratio, brittleness index, wellbore stability, porosity, permeability, hydrocarbon content, lithology, faults, and/or clay content. Determining the plurality of potential well trajectories can include, for each trajectory, determining the plurality of well segments, each well segment characterizing an extension of the well from a segment start position in a random, pseudorandom, or a direction determined based on a computed gradient. The random or pseudorandom direction can be determined subject to well constraints. The well constraints can include stress state, wellbore orientation and inclination, minimum mud weight, maximum mud weight, material properties, proximity to another well, proximity to a natural object, proximity to a man-made object, and/or pipe deviation limitations. Constraints can be characterized by one or more interval ranges to account for uncertainty in the reservoir parameters.

Determining the plurality of potential well trajectories can include, for each trajectory, determining the plurality of well segments, each well segment characterizing an extension of the well from a segment start position, the extension in a direction based on an objective function evaluated for a respective position of the segment and using the reservoir properties. The production contributions of each potential well trajectory can be characterized by: porosity value; permeability value; total organic content value; saturation value; a product of permeability value and total organic content; a product of permeability and saturation of mobile total organic content; a fracability index derived from rock mechanical properties and stresses; a brittleness index; well stability; and/or a mathematical combination of such values.

The providing can include transmitting, storing, and/or displaying. In some implementations, the providing of the final well trajectory can include transmitting the final well trajectory, storing (e.g., in memory) the final well trajectory, displaying the final well trajectory, and/or further processing of the final well trajectory. At least one of the receiving, the determining, the evaluating and the providing can be performed by at least one data processor forming part of at least one computing system.

Non-transitory computer program products (i.e., physically embodied computer program products) are also described that store instructions, which when executed by one or more data processors of one or more computing systems, causes at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including a connection over a network (e.g. the Internet, a wireless wide area network, a local area network, a wide area network, a wired network, or the like), via a direct connection between one or more of the multiple computing systems, etc.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

As noted above, oil well planning can include identifying a starting point of the well and a trajectory (e.g., path) to an end point or reservoir boundary. The oil well plan can be designed to achieve high production from the well. But some approaches to well planning can be sub-optimal because they require input by a subject matter expert and may require iteration between a well planning team and a well drilling team. Sub-optimal plans can result in reduced production such that oil and other resources are left in the ground (e.g., not extracted), the well plan may not be feasible (e.g., it may not be possible to drill the well), and drilling the sub-optimal well plan may result in ground collapse, which can be dangerous and costly. Accordingly, some implementations of the current subject matter provide for improved well planning, which can increase well productivity.

Figure 1:
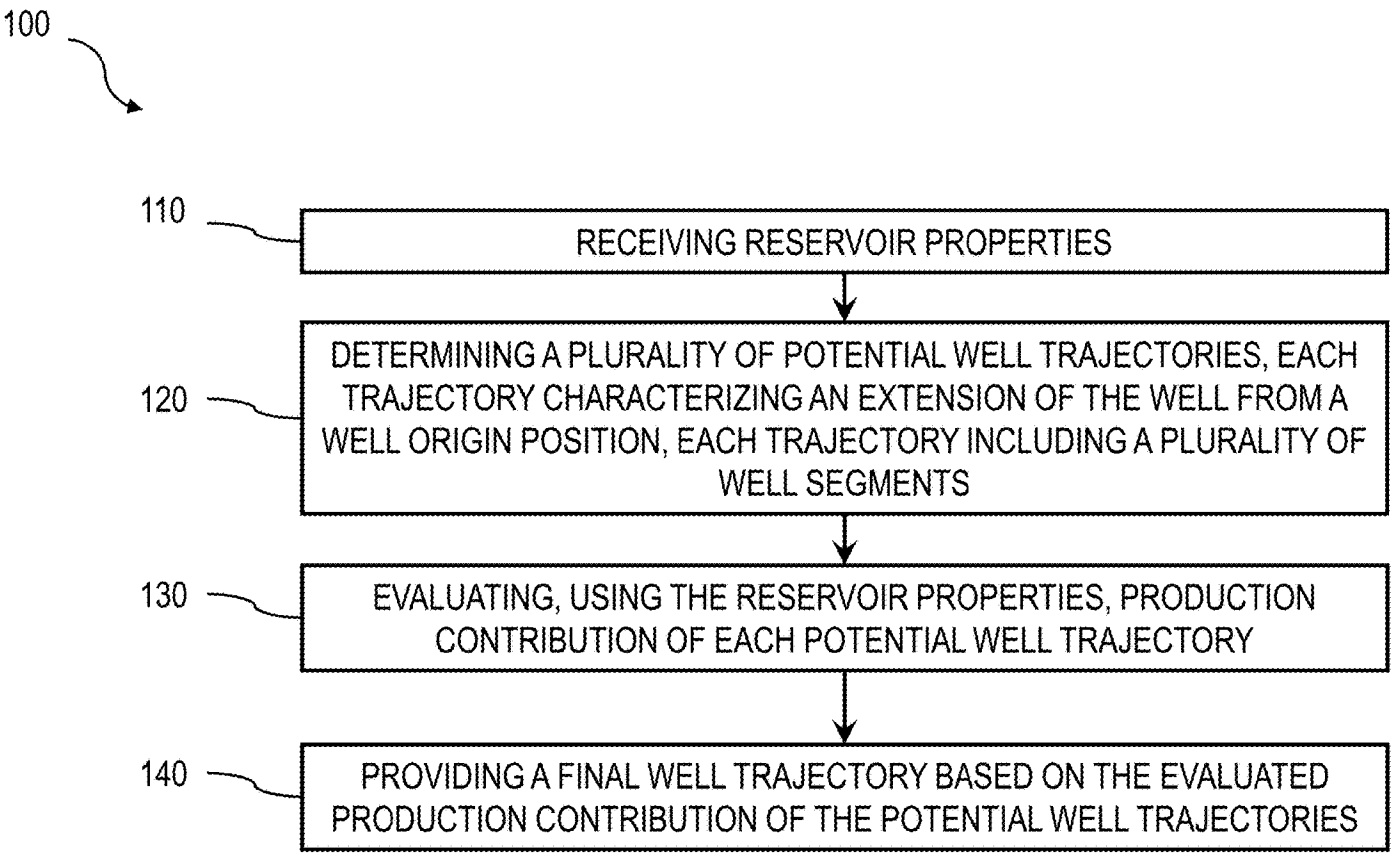
FIG. 1 is a process flow diagram illustrating an example process of some implementations of the current subject matter that can provide for improved well planning, which can increase well productivity.

FIG. 1 is a process flow diagram illustrating an example process 100 of some implementations of the current subject matter that can provide for improved well planning, which can increase well productivity.

At 110, reservoir properties can be received. The reservoir properties can include rock facies, pore pressure, fracture gradient, stresses, Young's modulus, Poisson's ratio, porosity, permeability, hydrocarbon content, saturations, lithology, faults, and/or clay content. The reservoir properties can be generated as a result of characterizing (e.g., mapping) the reservoir; and identifying rock properties and potential high productivity spots based on raw logging data, resistivity data, seismic data, core data, drill cuttings, outcrop data, and the like.

At 120, a plurality of potential well trajectories can be determined. Each trajectory can characterize an extension of the well from a well origin position (e.g., a well start position, such as a pad position). Each trajectory can include a plurality of well segments. For example, each well segment can be characterized as a line segment between two points (e.g., a segment start position and a segment end position), a segment start position and an angle (e.g., azimuth, inclination), and the like. Points can be expressed as subsurface location coordinates.

In some implementations, determining the plurality of potential well trajectories can include, for each trajectory, determining the plurality of well segments that comprise the well trajectory. Determining a well segment can include determining and/or selecting a direction to extend the well trajectory. In some implementation, the direction to extend the well can be chosen according to a randomization scheme such that the direction can be random. For example, this can be considered as a random walk scheme in which, the origin (e.g., well start position) of the wellbore is advanced successively in small increments in random directions. In some implementations, because true randomness may not be achievable in a computing system, the direction may be considered a pseudorandom direction. In some implementations, each well segment can characterize an extension of the well from a segment start position in a random or pseudorandom direction.

In some implementation, the direction and/or length of the wellbore extension can specified by a vector in three-dimensional (3D) space. In some implementation, the direction of the wellbore extension can be specified by a new location in 3D space, which in combination with the previous location in 3D space can define the orientation and length of the next wellbore segment. In some implementation, the direction of the wellbore extension can be specified by two angles and a length metric, such as azimuth (e.g., measuring orientation in a North-East plane), inclination (e.g., measuring departure from the vertical direction), and measured depth (e.g., a distance quantity). In some implementation, the depth and/or inclination of the next wellbore segment can be specified to follow a pre-defined depth-distance relation, which can be established by a formula, by a planar or non-planar surface in 3D space, and/or the like. The latter case can be interesting when a reservoir varies in depth and the wellbore can be desired to remain in the reservoir. The surface can, for example, be established as the mid-plane between top and bottom horizon of the reservoir. Another method to maintain a non-horizontal well trajectory in a reservoir can include first moving the reservoir properties into a two-dimensional (2D) plane, then execute the disclosed method to identify the optimum well-path in 2D, and then compute the appropriate depth of each wellbore segment.

In some implementation, the user prescribes an initial well path as a starting point, which can then be perturbed. Perturbations can be made on a segment scale (e.g., by adjusting one or more well bore segments or survey points or inclination and/or azimuth angles, or on a wellbore scale by transforming parts or the entire well in 3D space; transformations can include translations in space, rotations, scaling of coordinates).

In some implementations, the direction to extend a potential well trajectory can be subject to constraints. For example, there may be a limited amount a well can bend during the drilling process (e.g., radius of curvature). For example, if a well drilling machine can provide, at most, for 3 degrees of directional change per 100 feet at any location along the wellbore, the build rate may be determined as being randomly selected from the range −3/100 to 3/100 degree/foot. Other constraints can include stress state, wellbore orientation, inclination, material properties, mud weight (e.g., wellbore stability), proximity to existing or planned wells in the reservoir (collision avoidance), and pipe deviation limitations (e.g., build rate).

In some implementations, the direction to extend a potential well segment can be chosen in a direction based on an objective function evaluated for the respective position of the segment and using the reservoir properties. For example, a gradient descent (or conjugate gradient descent) can be used to compute the direction of the next wellbore segment (e.g., walk uphill or downhill in a non-random direction, or sideways, or both, and according to an objective function).

In some implementations, different approaches can be utilized to identify which well path or well trajectory maximizes an objective function. These approaches can include random walk, random walk with random adjustment, random walk with non-random adjustment, gradient descent, random walk with tree search, maximized objective function gradient, and inversion.

A random walk approach can include, from the origin, advancing the wellbore successively in small increments in random directions and selecting the best well from the ensemble. A random walk with random adjustment in which a random walk scheme is performed, but followed by adjusting one or more wellbore trajectory segments in a random direction. A random walk with non-random adjustment approach can include a random walk, but adjustments can be non-random. Instead, well bore segments can be adjusted so that one segment can move towards a higher value of the objective function. Other segments can be adjusted so that drillability constraints can be matched. Gradient descent (or conjugate gradient descent) can be used to compute the direction of the next wellbore segment (e.g., walk uphill or downhill in a non-random direction, or sideways or both). Random walk using a tree search can include a random walk whereby each segment branches off with more than one segment. Each full wellbore lineage can be treated as a separate wellbore. Heuristic pruning can be utilized. The maximized objective function gradient approach can include choosing a direction that can be in the direction of maximum objective function gradient. Inversion can include formulating a mathematical characterization of a well path where the azimuth and inclination of each segment are free parameters, application of well constraints, and mathematically solving for drill trajectory parameters that maximize the objective function.

In some implementations, damping can be utilized to avoid numerical oscillations. In some implementations, the objective function can be smoothed in 3 Dimensional space, which can aid in avoiding issues from small-scale scatter.

In some implementations, multiple object functions can be combined by using weights. In some implementations, multiple constraints can be satisfied simultaneously. In some implementations, an objective function can be maximized while satisfying one or more constraints.

At 130, production contribution of each potential well trajectory can be evaluated using the reservoir properties. How production contribution can be evaluated can vary and can be characterized by an objective function. For example, the production contributions of each potential well trajectory can be characterized by: porosity value; permeability value; total organic content; a combination of several values such as a product of permeability value and total organic content; a product of permeability and saturation of mobile total organic content; a fracability index derived from rock mechanical properties and stresses; a brittleness index; and/or well stability.

In some implementations, evaluating production contribution can include evaluating the objective function, which can be evaluated along the entire well, or along well segment(s) inside the reservoir, and/or at one or more specific locations (such as perforation clusters or stages), and/or a combination thereof. In some implementations, the objective function can be maximized, can be summed or integrated over those values; can be taken as the maximum, or another statistical metric such as the average, the p90, and the like.

At 140, a final well trajectory can be provided. The final well trajectory can include the potential trajectory that is evaluated as including the greatest production contribution. In some implementations, additional well planning steps can be performed, such as performing casing design and completion design for the well, including detailed planning such as selecting the drill bits, designing a bottom hole assembly (BHA), selecting drilling fluid and the like. In some implementations, a well can be drilled using well drilling machinery and according to the final well trajectory.

In some implementations, the providing of the final well trajectory can include transmitting the final well trajectory, storing (e.g., in memory) the final well trajectory, displaying the final well trajectory, and/or further processing of the final well trajectory.

In some implementations, determining potential well trajectories can result in getting stuck in a local maximum (or minimum). This can occur when the objective function has multiple scattered local extrema. In such a case, depending on the approach utilized to determine the potential well trajectories, the search radius can be increased to find an appropriate direction. In some implementation, different well path starting points can be considered. In some implementation, the objective function can be smoothed so that fewer local extrema exist. In some implementations, directions can be selected based on the reservoir center such that successive extensions follow in roughly the same direction, towards reservoir center, or towards a direction to create the longest well in lease boundaries or in reservoir volume.

In some implementations, sub-surface uncertainty may be present. In some implementations, interval analysis may be employed to obtain a range of acceptable lower bounds and upper bounds on the mud weight needed for stability considerations for each wellbore segment when filtering out un-drillable wells using user specified mud weight limits. In some implementations, interval analysis may be applied to any input parameter that has uncertainty associated with it allowing the algorithm to compute a number of acceptable well paths based on the amount of uncertainty in the inputs.

Figure 2:
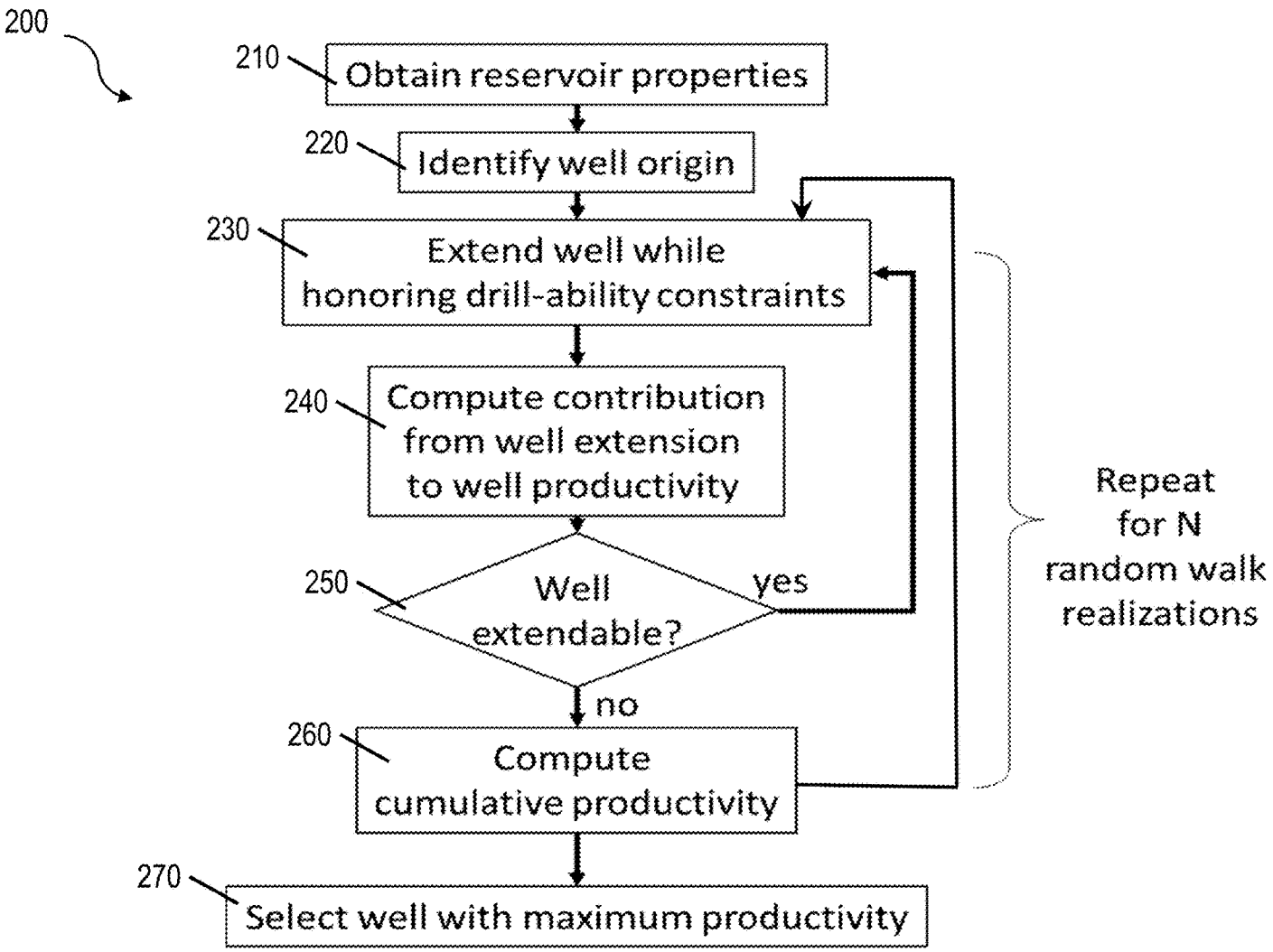
FIG. 2 is a process flow diagram illustrating another example method according to some implementations that can provide for improved well planning, which can increase well productivity.

FIG. 2 is a process flow diagram illustrating another example method 200 according to some implementations that can provide for improved well planning, which can increase well productivity.

At 210, reservoir properties can be obtained. The reservoir properties can include pore pressure, fracture gradient, stresses, Young's modulus, Poisson's ratio, rock facies, porosity, hydrocarbon content, permeability, saturations, lithology, faults, wellbore stability and/or clay content. At 220, a well origin can be identified. The well origin can include the well head and/or an initial landing point. In some implementations, the well origin can include a point on a predetermined well segment.

At 230, for a given potential well trajectory, the trajectory can be extended by a segment subject to drill-ability and wellbore stability constraints. The extension can be from the well origin. At 240, the contribution from well extension to well productivity can be computed. At 250, it can be determined whether the potential well trajectory is extendable. This determination can include determining whether a well extension is feasible (e.g., satisfies all constraints).

If the well is extendable, the process 200 can return to step 230 and extend the potential well trajectory starting from the end of the prior well segment and subject to the constraints. In some implementations, the process can repeat steps 230, 240 and 250 until extension of the well is no longer feasible (e.g., no additional segment can be determined that satisfies all constraints), until a predetermined number of segments have been determined, or the well has reached the reservoir boundary.

If the well is not extendable, the potential well segment can be evaluated by at least computing the cumulative productivity according to the objective function. The potential well segment can be added as one realization to the set of potential well segments and it can be determined whether N realizations of potential well trajectories have been computed. If N realization have not been computed, the process can return to step 230 to determine a new realization of a potential well segment. In this case, a segment for extending the well can be determined but starting again from the well origin. In some implementations, steps 230, 240, 250, and 260 are computed. If N realization segments have been computed, then at 270, the potential well trajectory having the maximum (e.g., greatest) productivity in the ensemble can be selected as the final well trajectory.

Figure 3:
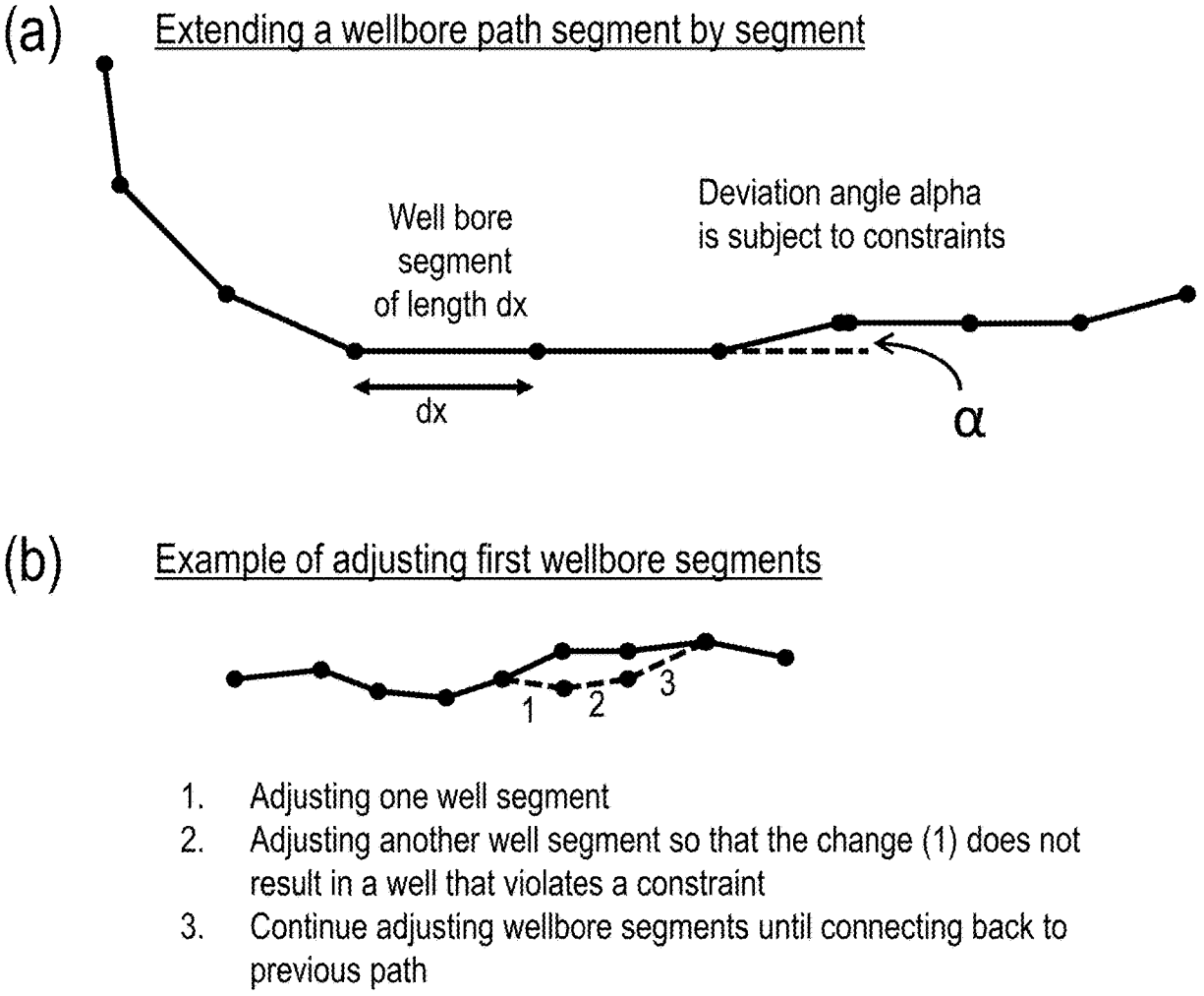
FIG. 3 is a diagram illustrating an example of a well trajectory.

FIG. 3 is a diagram illustrating an example of a well trajectory. At 3A, a trajectory extend is defined by well segments, with each segment having a respective length (dx), and deviation angle between segments (a). At 3B is an example of adjusting well bore segments. Adjusting a well bore segment can be useful when, for instance, a well bore segment does not satisfy a constraint (e.g., deviation constraint, wellbore stability constraint, collision avoidance constraint), and can include several of the following steps: the well bore segment that does not satisfy a constraint can be reoriented so that is does satisfy the constraint; in succession, the next adjacent segment or segments can be adjusted so it also satisfies a constraint, until the path defined by the adjusted segments reconnects to a previous segment.

Figure 4:
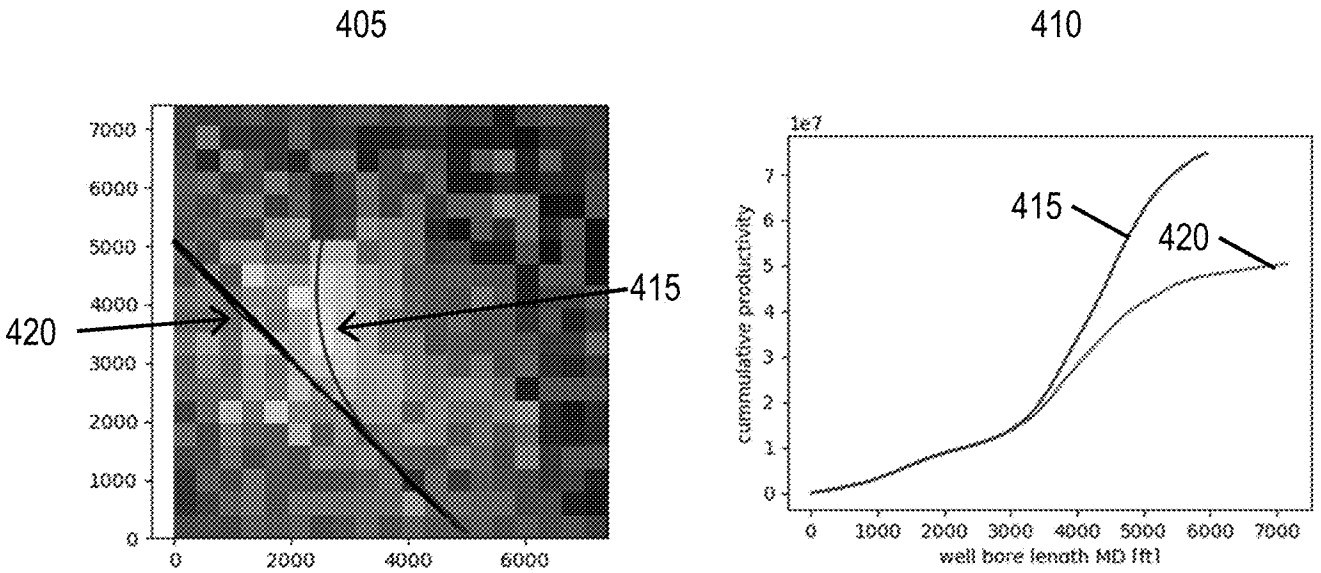
FIG. 4 includes a surface map illustrating an example of an objective function (e.g., in this case based on porosity) distributed in the reservoir volume and multiple wells traversing the volume and (right) the objective function evaluated as cumulative productivity along the well bore length.

FIG. 4 includes a surface map 405 illustrating an example of an objective function (e.g., in this case based on porosity) distributed in the reservoir volume (shown as a horizontal slice, with subsurface coordinates shown along the x and y axis) and multiple wells traversing the volume and (right) the objective function evaluated as cumulative productivity along the well bore length. The well 415 curving towards the center of the surface plot has a higher productivity, which can be attributed to its traversal of the elevated permeability region.

Figure 5:
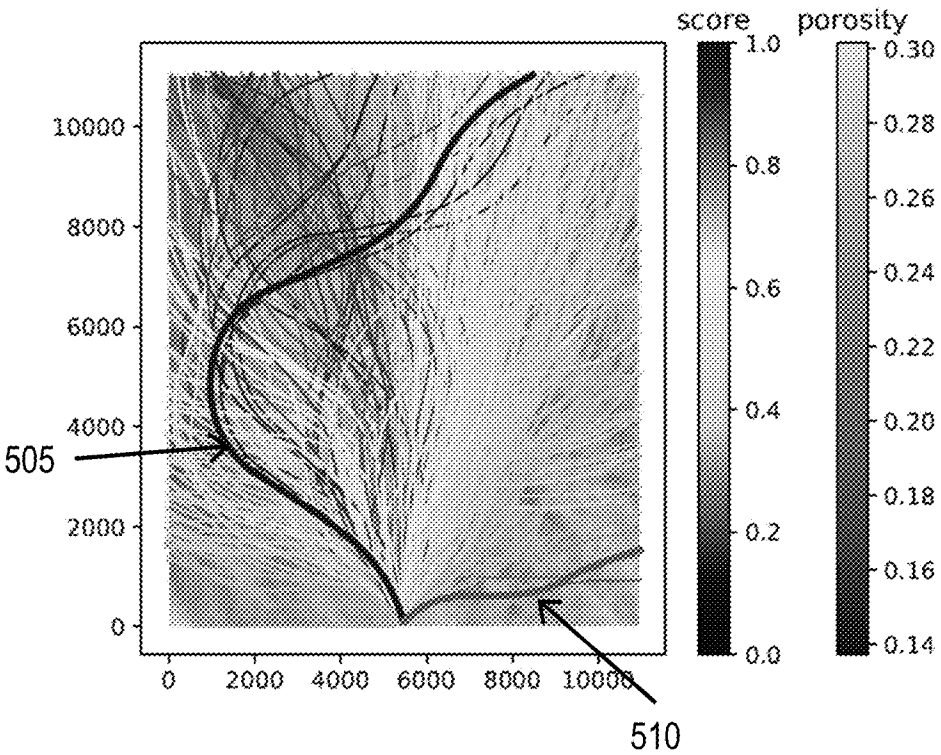
FIG. 5 is a surface plot illustrating an example of an objective function (porosity in this case) distributed in the reservoir volume and randomly created wells (e.g., Sobol sampled) traversing the volume.

FIG. 5 is a surface plot illustrating an example of an objective function (porosity in this case) distributed in the reservoir volume and 300 randomly created wells (e.g., Sobol sampled) traversing the volume and all starting at the same landing point (e.g., well origin point). The worst and best wells are shown as thicker lines 505 and 510, respectively.

Figure 6:
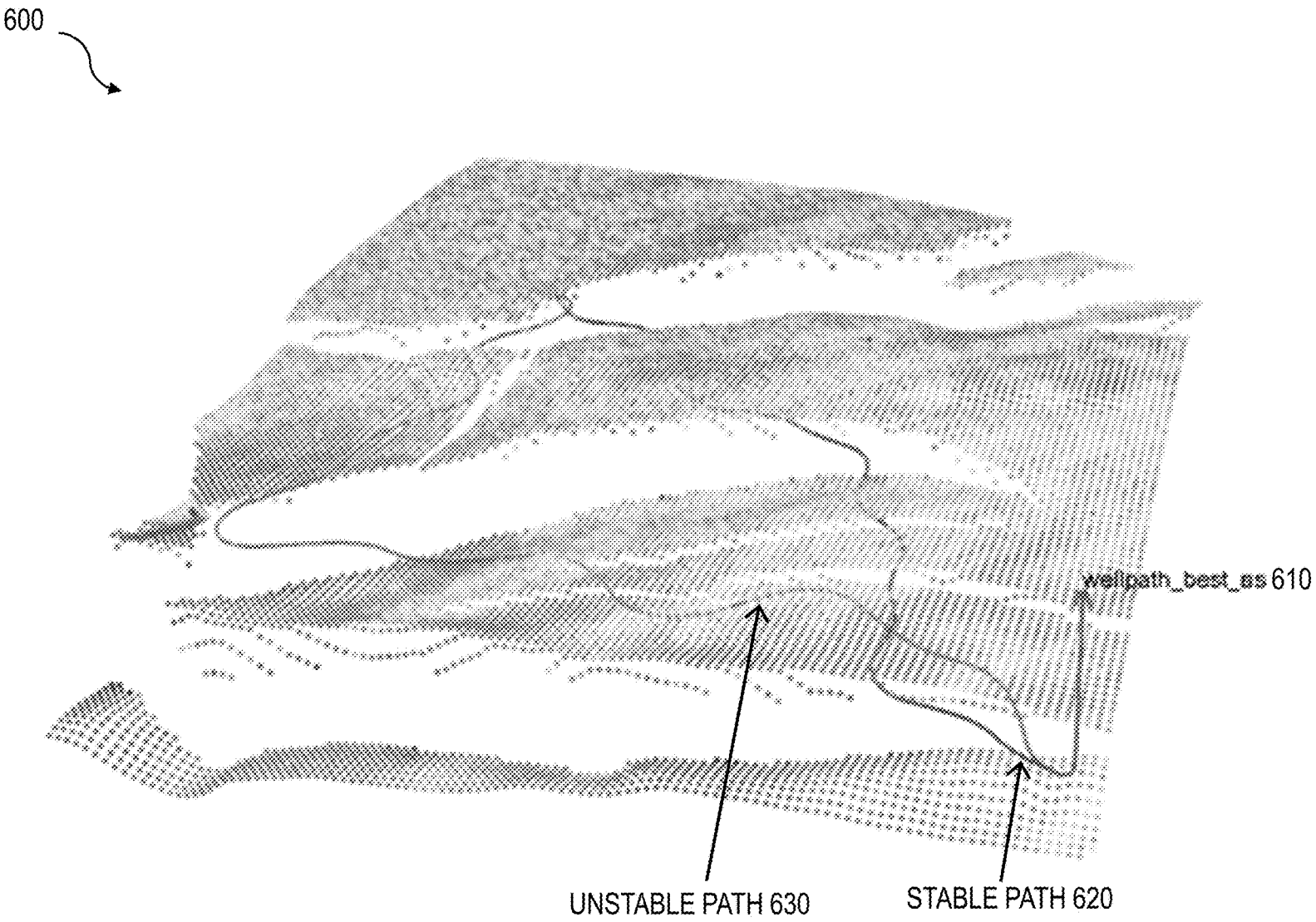
FIG. 6 is a three-dimensional visualization of well paths through a faulted reservoir.

FIG. 6 is a three-dimensional visualization 600 illustrating optimum stable and unstable well paths through a faulted reservoir. The stability of these wells can be determined by wellbore stability considerations including, for example, stress state, mud weight window, and the direction of a wellbore segment of each wellbore path. For example, visualization 600 can include wellbore wellpath_best_as 610. Wellbore 610 can include an optimum stable well path 620 and an optimum unstable well path 630.

Figure 7:
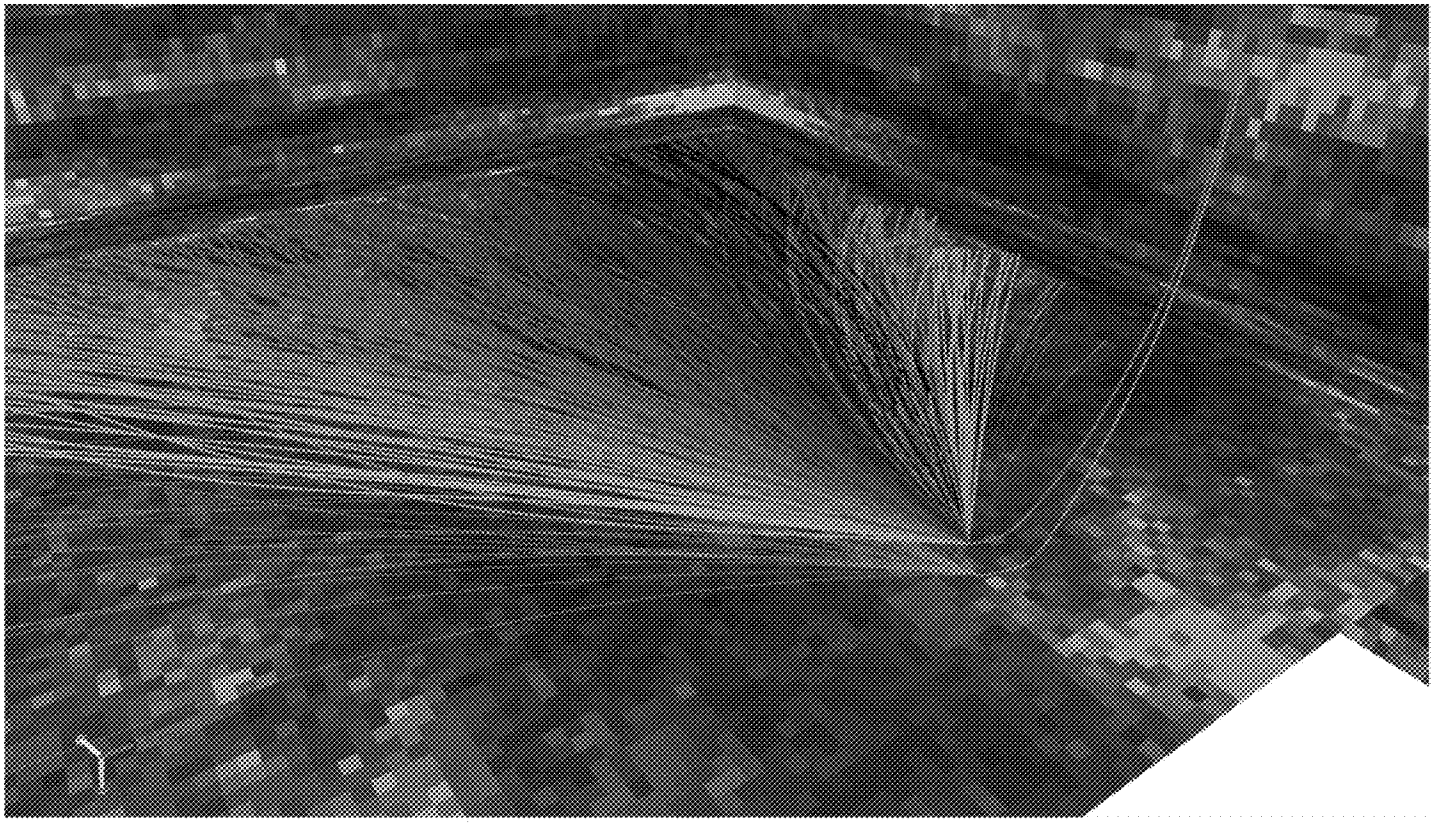
FIG. 7 is a three-dimensional visualization of multiple wells in a three-dimensional grid.
Figure 8:
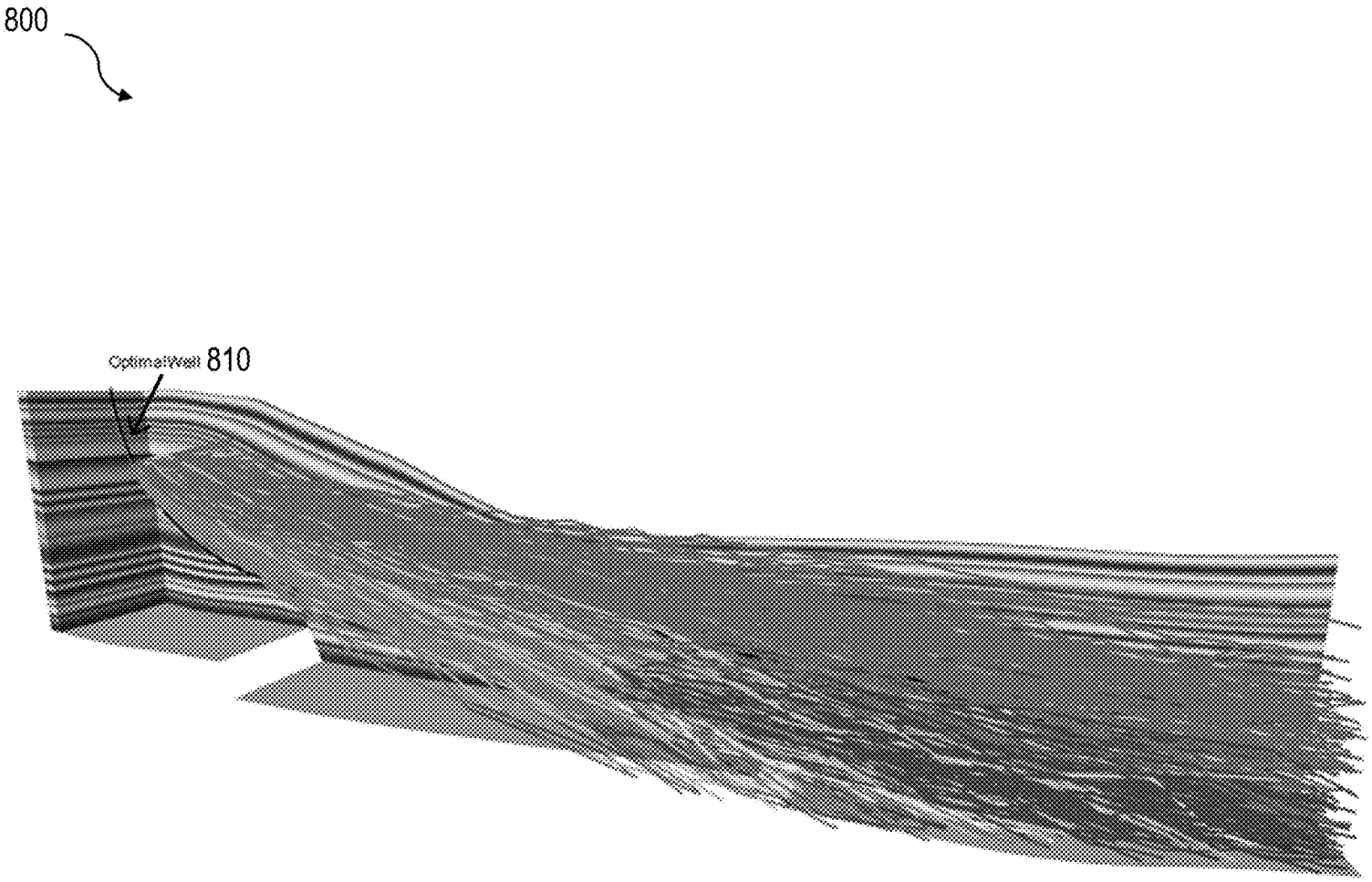
FIG. 8 is a three-dimensional visualization of multiple wells in a dipping formation.

FIG. 7 is a three-dimensional visualization 700 illustrating multiple wells in a three-dimensional (3D) grid. The 3D grid can be visualized by means of several two-dimensional slices that can offer the viewer perspective and can inform on the level of heterogeneity of relevant subsurface properties. A plurality of well paths can be displayed and can inform the viewer of the covered subsurface space. The plurality of wells can be trimmed by eliminating wells that do not satisfy all of the constraints, and the optimum well path (e.g. the path for which the objective function is maximized) can be selected. FIG. 8 is a three-dimensional visualization 800 illustrating multiple wells in a dipping formation. For example, visualization 800 can illustrate an optimal well 810. FIGS. 6, 7 and 8 can used to visualize grid properties and well trajectories and can be generated with software that allows visualization of objects in 3D space, such as BHGE's JewelSuite™ Software.

Although a few variations have been described in detail above, other modifications or additions are possible. For example, in some implementations, the objective function can be expressed in terms of a financial metric, cost of well can be incorporated into objective function. In some implementations, aspects of the current subject matter can be applied to optimize multiple wells on the pad. An objective function can be utilized that includes productivity from all wells.

In some implementations, maximum deviation and central path (go straight) for each new wellbore segment can be utilized to cover the maximum range of possible well paths. Sampling within the range can be performed, and the optimum can be found by either brute force/Monte Carlo or gradient descent-type methods.

In some implementations, constraint optimization can be used to identify the optimum with either hard or soft limits. Constrained optimization (in some contexts called constraint optimization) can include the process of optimizing an objective function with respect to some variables in the presence of constraints on those variables. The objective function can include a cost function or energy function, which is to be minimized, or a reward function or utility function, which is to be maximized. Constraints can be either hard constraints, which set conditions for the variables that are required to be satisfied, or soft constraints, which have some variable values that are penalized in the objective function if, and based on the extent that, the conditions on the variables are not satisfied. In some implementations, multiple objective functions can be combined and/or multiple constraints are combined.

The subject matter described herein can provide a number of technical advantages. For example, some implementations of the current subject matter can improve upon well trajectories that are planned by manual considerations, whereby the truly optimal well is likely not identified because not all possible wells can be evaluated by a human. Well planning can be accelerated compared to some existing processes and an objective criteria can be evaluated for determining the best well path.

In some implementations, the subject matter improves system execution time. Some current systems require weeks, or even months, when planning a well trajectory because it can involve numerous iterations between a geoscientist, who can be focused on the targeting the pay zone, and a drilling engineer, who can be focused on the drilling constraints such as surface location, dog leg severity factor, geomechanical constraints, and can make sure the new well path is not close to any existing wells in the reservoir. Further iterations can involve the asset manager, who can be trying to capitalize on the existing infrastructure in the form of surface facilities.

In some implementations, which involve searching through wellbore path solution space and taking the best of all possible solutions, each wellbore path is independent from any other can be advantageous because this approach can be computationally parallelized and it can be possible in some implementations to obtain ideal linear speed-up.

In some implementations, the described random well bore extension approach may not depend on numerical or mathematical techniques that are known to, at times, have convergence or inversion issues. Given enough trials, some aspects of the current subject matter can reliably identify a drillable well bore path if there is a possible one, even when other approaches cannot. In addition, this method can require lower memory (e.g., RAM) usage as compared to some other approaches. Furthermore, in some implementations, a modest number of trials can produce what might be an acceptable well path, even if a larger number will determine a better path.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including acoustic, speech, or tactile input. Other possible input devices include touch screens or other touch-sensitive devices such as single or multi-point resistive or capacitive trackpads, voice recognition hardware and software, optical scanners, optical pointers, digital image capture devices and associated interpretation software, and the like.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A method comprising:

receiving reservoir properties of a reservoir;

determining a plurality of potential well trajectories through the reservoir, each potential well trajectory characterizing an extension of a well from a well origin position, each potential well trajectory including a plurality of well segments, wherein determining the plurality of potential well trajectories includes determining the plurality of well segments, each well segment characterizing an extension of the well in a random direction from the well origin position and wherein the plurality of well segments includes a first well segment and a second well segment following the first well segment, the second well segment determined to have a depth based on a pre-defined depth-distance relationship with the first well segment;

evaluating, using the reservoir properties, a production contribution of each potential well trajectory; and providing a final well trajectory based on the evaluated production contributions of the plurality of potential well trajectories, wherein the providing the final well trajectory includes displaying the final well trajectory in a horizontal slice of a volume of the reservoir with respect to an objective function corresponding to a porosity of the reservoir.

2. The method of claim 1, further comprising:

drilling, using well drilling machinery, the well and according to the final well trajectory.

3. The method of claim 1, wherein the reservoir properties include density, pore pressure, fracture gradient, stresses, saturations, Young's modulus, Poisson's ratio, brittleness index, wellbore stability, porosity, permeability, hydrocarbon content, lithology, faults, and/or clay content.

4. The method of claim 1, wherein the random direction is determined subject to well constraints.

5. The method of claim 4, wherein the well constraints include stress state, wellbore orientation and inclination, minimum mud weight, maximum mud weight, material properties, proximity to another well, proximity to a natural object, proximity to a man-made object, and pipe deviation limitations.

6. The method of claim 1, wherein determining the plurality of potential well trajectories includes, for each potential well trajectory, determining the plurality of well segments, each well segment characterizing an extension of the well from a segment start position, the extension in a direction based on an objective function evaluated for a respective position of the well segment and using the reservoir properties.

7. The method of claim 1, wherein the production contributions of the plurality of potential well trajectories are characterized by: porosity value; permeability value; total organic content value; saturation value; a product of permeability value and total organic content; a product of permeability and saturation of mobile total organic content; a fracability index derived from rock mechanical properties and stresses; a brittleness index; well stability; and/or a mathematical combination of such values.

8. The method of claim 1, wherein the providing includes transmitting, and/or storing.

9. The method of claim 1, wherein at least one of the receiving, the determining, the evaluating and the providing is performed by at least one data processor forming part of at least one computing system.

10. The method of claim 1, wherein constraints are characterized by one or more interval ranges to account for uncertainty in the reservoir properties.

11. A system comprising:

at least one data processor; and memory storing instructions configured to cause the at least one data processor to perform operations comprising:

receiving reservoir properties of a reservoir;

determining a plurality of potential well trajectories through the reservoir, each potential well trajectory characterizing an extension of a well from a well origin position, each potential well trajectory including a plurality of well segments, wherein determining the plurality of potential well trajectories includes determining the plurality of well segments, each well segment characterizing an extension of the well in a random direction from the well origin position and wherein the plurality of well segments includes a first well segment and a second well segment following the first well segment, the second well segment determined to have a depth based on a pre-defined depth-distance relationship with the first well segment;

evaluating, using the reservoir properties, production contribution of each potential well trajectory; and providing a final well trajectory based on the evaluated production contributions of the plurality of potential well trajectories, wherein the providing the final well trajectory includes displaying the final well trajectory in a horizontal slice of a volume of the reservoir with respect to an objective function corresponding to a porosity of the reservoir.

12. The system of claim 11, the operations further comprising:

drilling, using well drilling machinery, the well and according to the final well trajectory.

13. The system of claim 11, wherein the reservoir properties include density, pore pressure, fracture gradient, stresses, saturations, Young's modulus, Poisson's ratio, brittleness index, wellbore stability, porosity, permeability, hydrocarbon content, lithology, faults, and/or clay content.

14. The system of claim 11, wherein the random direction is determined subject to well constraints.

15. The system of claim 14, wherein the well constraints include stress state, wellbore orientation and inclination, minimum mud weight, maximum mud weight, material properties, proximity to another well, proximity to a natural object, proximity to a man-made object, and pipe deviation limitations.

16. The system of claim 11, wherein determining the plurality of potential well trajectories includes, for each potential well trajectory, determining the plurality of well segments, each well segment characterizing an extension of the well from a segment start position, the extension in a direction based on an objective function evaluated for a respective position of the well segment and using the reservoir properties.

17. The system of claim 11, wherein the production contributions of the plurality of potential well trajectories are characterized by: porosity value; permeability value; total organic content value; saturation value; a product of permeability value and total organic content; a product of permeability and saturation of mobile total organic content; a fracability index derived from rock mechanical properties and stresses; a brittleness index; well stability; and/or a mathematical combination of such values.

18. A non-transitory computer program product storing instructions which, when executed by at least one data processor forming part of at least one computing system, cause the at least one data processor to implement operations comprising:

receiving reservoir properties of a reservoir;

determining a plurality of potential well trajectories through the reservoir, each potential well trajectory characterizing an extension of a well from a well origin position, each potential well trajectory including a plurality of well segments, wherein determining the plurality of potential well trajectories includes determining the plurality of well segments, each well segment characterizing an extension of the well in a random direction from the well origin position and wherein the plurality of well segments includes a first well segment and a second well segment following the first well segment, the second well segment determined to have a depth based on a pre-defined depth-distance relationship with the first well segment;

evaluating, using the reservoir properties, a production contribution of each potential well trajectory; and providing a final well trajectory based on the evaluated production contributions of the plurality of potential well trajectories, wherein the providing the final well trajectory includes displaying the final well trajectory in a horizontal slice of a volume of the reservoir with respect to an objective function corresponding to a porosity of the reservoir.

* * * * *